US005181253A

United States Patent [19]

Jordan

[11] Patent Number: 5,181,253

[45] Date of Patent: Jan. 19, 1993

[54] LOUDSPEAKER ASSEMBLY

[75] Inventor: Jeff B. Jordan, Baton Rouge, La.

[73] Assignee: Southern Audio Services, Inc., Baton Rouge, La.

[21] Appl. No.: 638,696

[22] Filed: Jan. 8, 1991

[51] Int. Cl.[5] ..... H04R 25/00

[52] U.S. Cl. ..... 381/199; 381/182; 381/188; 381/205

[58] Field of Search ..... 381/199, 188, 182, 186, 381/205, 192, 201, 194

[56] References Cited

U.S. PATENT DOCUMENTS

| | | | |
|---|---|---|---|
| 1,952,889 | 3/1934 | Pocock et al. | 381/204 |
| 4,465,905 | 8/1984 | Nation | 381/201 |
| 4,492,826 | 1/1985 | Chiu | 381/188 |
| 4,550,229 | 10/1985 | Hwang | 381/194 |
| 4,608,463 | 8/1986 | Burgess et al. | 381/199 |
| 4,811,406 | 3/1989 | Kawachi | 381/188 |
| 4,821,331 | 4/1989 | Murayama et al. | 381/188 |

FOREIGN PATENT DOCUMENTS

| | | | |
|---|---|---|---|
| 2542551 | 9/1984 | France | 381/193 |

*Primary Examiner*—James L. Dwyer
*Assistant Examiner*—Jason Chan
*Attorney, Agent, or Firm*—William David Kiesel; Robert C. Tucker

[57] ABSTRACT

In a loudspeaker having a yoke assembly including a top plate and a yoke fixedly attached to opposite sides of a magnet to form an air gap between the plate and the yoke into which a voice coil operatively extending from a diaphragm is positioned, the yoke affixed to a magnet base through which electrical terminals extend, one end of the terminals being operatively attached to the voice coil, the magnet base having an open end near the diaphram and being positioned in a housing and the magnet base having a grille covering its open end, and its end opposite the open end being enclosed by a base member of the housing, an improvement to the loudspeaker is provided which comprises the mounting plate having (i) a stud constructed having a head member fixed to the mounting plate and having a shaft extending upward from the plate and toward the yoke wherein the shaft has a threaded section of sufficient length to be screwed into a mating threaded opening in the center section of the yoke, and (ii) at least one passageway extending through the mounting plate to allow electrical wire to pass for operative attachment to the electrical terminals; and wherein the mounting plate is frictionally lockable to the yoke assembly when the threaded section is screwed into the threaded opening.

6 Claims, 7 Drawing Sheets

Fig. 4C
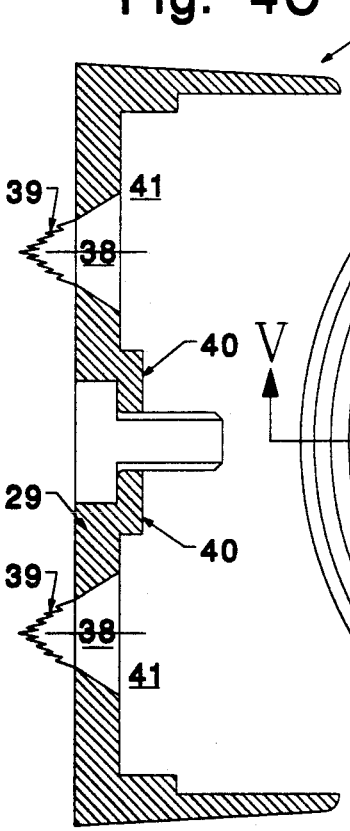
Fig. 4A
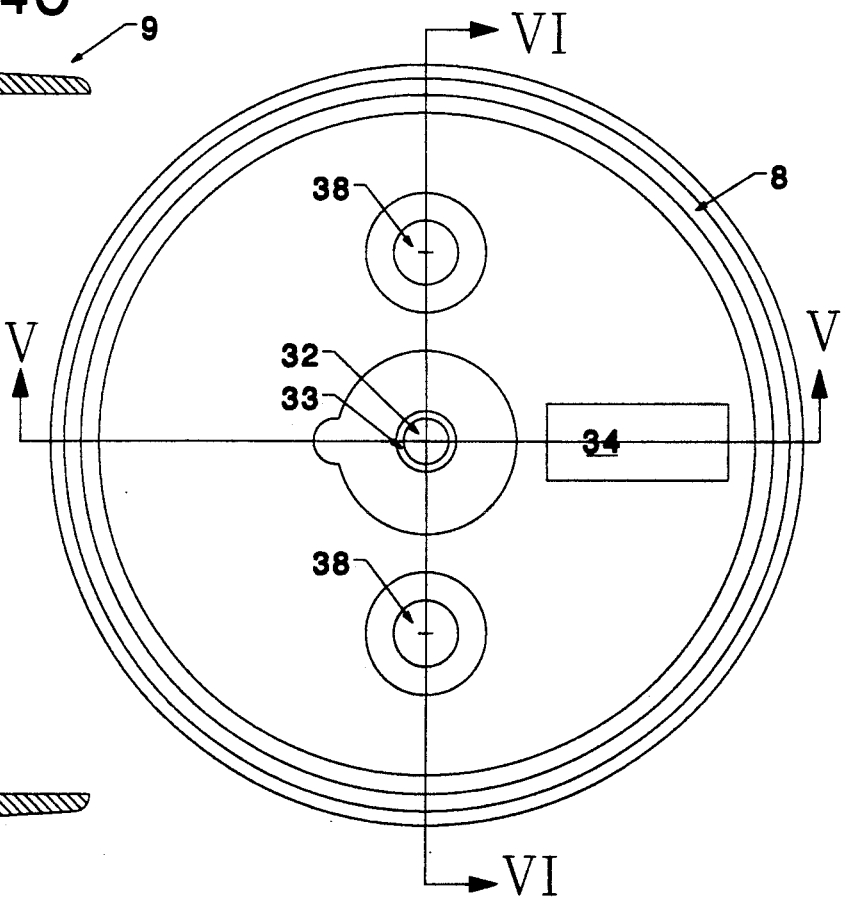
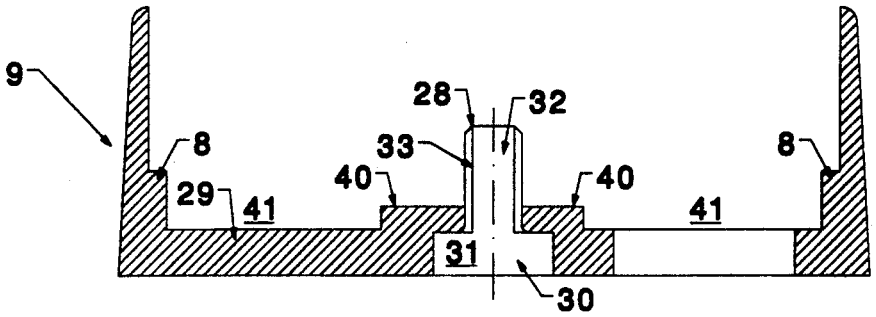
Fig. 4B

Fig. 5A
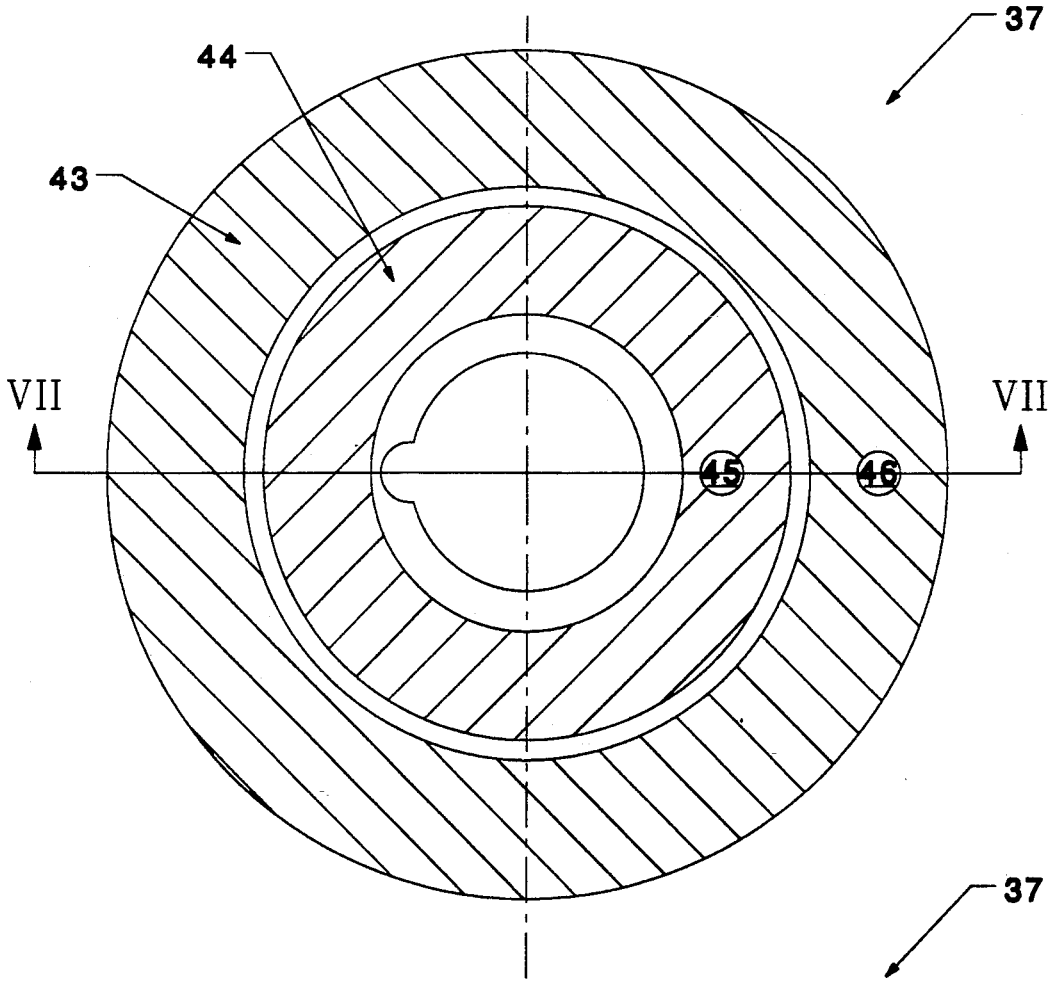
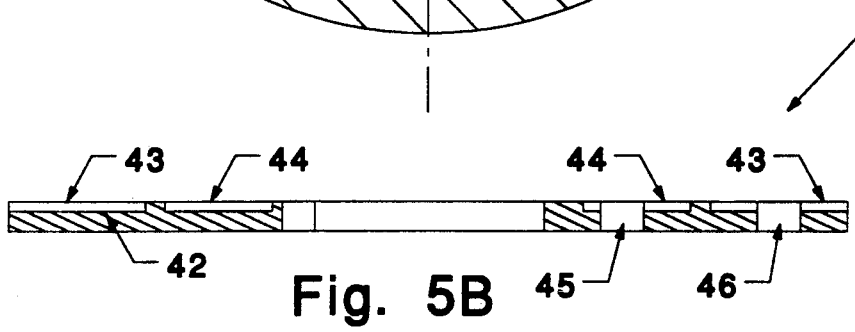
Fig. 5B

Fig. 6A
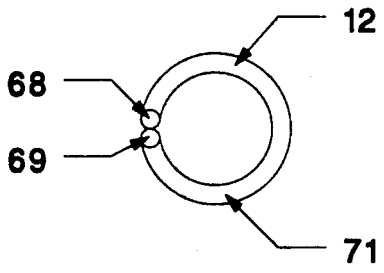
Fig. 6B
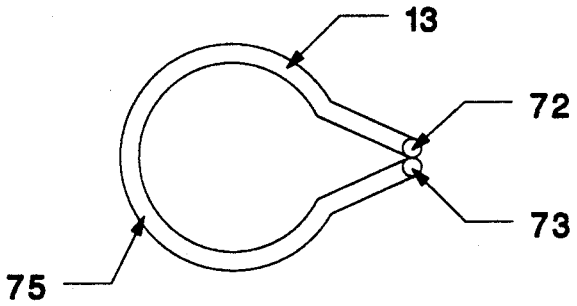
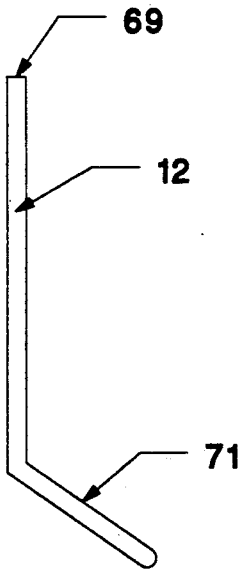
Fig. 6C
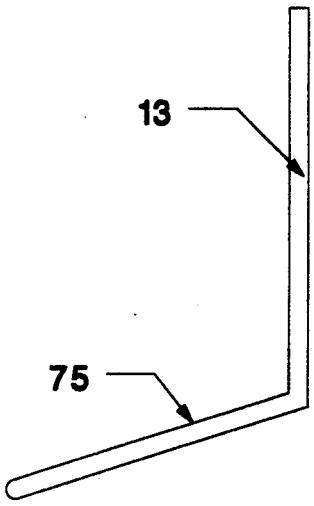
Fig. 6D

LOUDSPEAKER ASSEMBLY

BACKGROUND OF THE INVENTION

1. Field of the Invention

This invention relates in general to loudspeakers, and more particularly, to improved loudspeaker mounting configurations.

2. Prior Art

High frequency transducers or loudspeakers, whether a tweeter (generally considered 5,000 hertz frequency) or a woofer (generally considered 0–5,000 hertz frequency), typically include a permanent magnet for generating a magnetic field, and a yoke assembly consisting of yoke, magnet and plate pieces for focusing the magnetic field to an air gap in which the field is particularly intensified. A voice coil is suspended in the air gap so as to be able to vibrate. A current is passed through the voice coil, and the interaction of the magnetic field created by the current and the magnetic field from the permanent magnet causes the voice coil to vibrate. Attached to the voice coil is a diaphragm which has a large surface area to cause air in the vicinity of the diaphragm to vibrate, thus creating sound.

To obtain high quality sound it is important that the voice coil be disposed in the center of the air gap and not touch the yoke so that the voice coil can vibrate freely. To achieve this arrangement it is important that the relative positions of the pole pieces be rigidly fixed. Typically, plate pieces have been glued, cemented or bolted to the permanent magnet thus rigidly setting the width of the air gap.

To protect the permanent magnet from chipping and to overcome cementing problems it is typical for the permanent magnet and yoke to be encapsulated in plastic or the like.

In most typical configurations a non-magnetic rigid mounting plate is bolted to the enclosed magnet assembly. The diaphragm and the voice coil are attached to and suspended from the plate. Electrical leads from the voice coil are attached to terminals on the plate, to form a complete loudspeaker. The loudspeaker is then mounted to an enclosure forming a portion of a loudspeaker system.

While these systems do reduce the structure necessary to position the yoke and the permanent magnet, the remainder of the structure tends to be bulky due to the necessity of the mounting plate. In addition, since the voice coil must be accurately centered within the air gap the operation of bolting the mounting plate to the enclosed assembly becomes critical, and thus time consuming and expensive.

To overcome some of these problems U.S. Pat. No. 4,507,800 discloses the use of a housing having a quick bayonet type locking mechanism for locking the housing to the mounting plate, a circumferential groove which provides a receptacle for the loudspeaker grill, and a conduit through which conductors can pass to provide an electrical signal to the voice coil. Thus this design attempts to use the bayonet type locking mechanism between the housing and the mounting plate to achieve not only a quick assembly of the loudspeaker, but also utilization of a less bulky mounting plate without reducing the accurate positioning of the voice coil. While this design has reduced some of the prior art problems, there is still need to further simplify installation and assembly to more easily achieve alignment of the electrical contact members with the PC board, provide for greater portability of the loudspeaker by providing easier disassembly of the loudspeaker from the mounting plate, and further decrease the bulk of the loudspeaker and mounting plate assembly.

OBJECTS AND SUMMARY OF THE INVENTION

Therefore one object of this invention is to provide a loudspeaker that is simple to mount to any desired surface.

Another object of this invention is to provide a loudspeaker that has increased portability.

Still another object of this invention is to provide a loudspeaker wherein positive alignment of the electrical contacts with the PC board is assured whenever the loudspeaker is attached to the mounting plate.

A still further object of this invention is to provide a loudspeaker that is simpler to attach to or remove from the mounting plate.

Other objects and advantages of the invention will become apparent from the ensuing descriptions of the invention.

Accordingly, in a loudspeaker having a yoke assembly including a top plate and a yoke fixedly attached to opposite sides of a magnet to form an air gap between the plate and the yoke into which a voice coil operatively extending from a diaphragm is positioned, the yoke affixed to a magnet base through which electrical terminals extend, one end of the terminals being operatively attached to the voice coil, the magnet base having an open end near the diaphragm and being positioned in a housing and the magnet base having a grille covering its open end, and its end opposite the open end being enclosed by a base member of the housing, an improvement to the loudspeaker is provided which comprises the mounting plate having (i) a stud constructed having a head member fixed to the mounting plate and having a shaft extending upward from the plate and toward the yoke wherein the shaft has a threaded section of sufficient length to be screwed into a mating threaded opening in the center section of the yoke, and (ii) at least one passageway extending through the mounting plate to allow electrical wire to pass for operative attachment to the electrical terminals; and the mounting plate is frictionally lockable to the r yoke assembly when the threaded section is screwed into the threaded opening.

BRIEF DESCRIPTION OF THE DRAWINGS

FIG. 4A is a top view of the base member utilized in the preferred embodiment illustrated in FIG. 1.

FIG. 4B is a cross-sectional view of the base member taken along lines V—V of FIG. 4A.

FIG. 4C is a cross-sectional view of the base member taken along lines VI—VI of FIG. 4A.

FIG. 5A is a top view of the PC board utilized in the preferred embodiment illustrated in FIG. 1.

FIG. 5B is a cross-sectional view of the PC board taken along lines VII—VII of FIG. 5A.

FIG. 6A is a top view of one of the two terminal extension members utilized in the preferred embodiment the side view of which is illustrated in FIG. 1.

FIG. 6B is a top view of the other terminal extension member utilized in the preferred embodiment the side view of which is illustrated in FIG. 1.

FIG. 6C is a side view of the terminal extension member of FIG. 6A.

FIG. 6D is a side view of the terminal extension member of FIG. 6B.

PREFERRED EMBODIMENTS OF THE INVENTION

Figure 7:
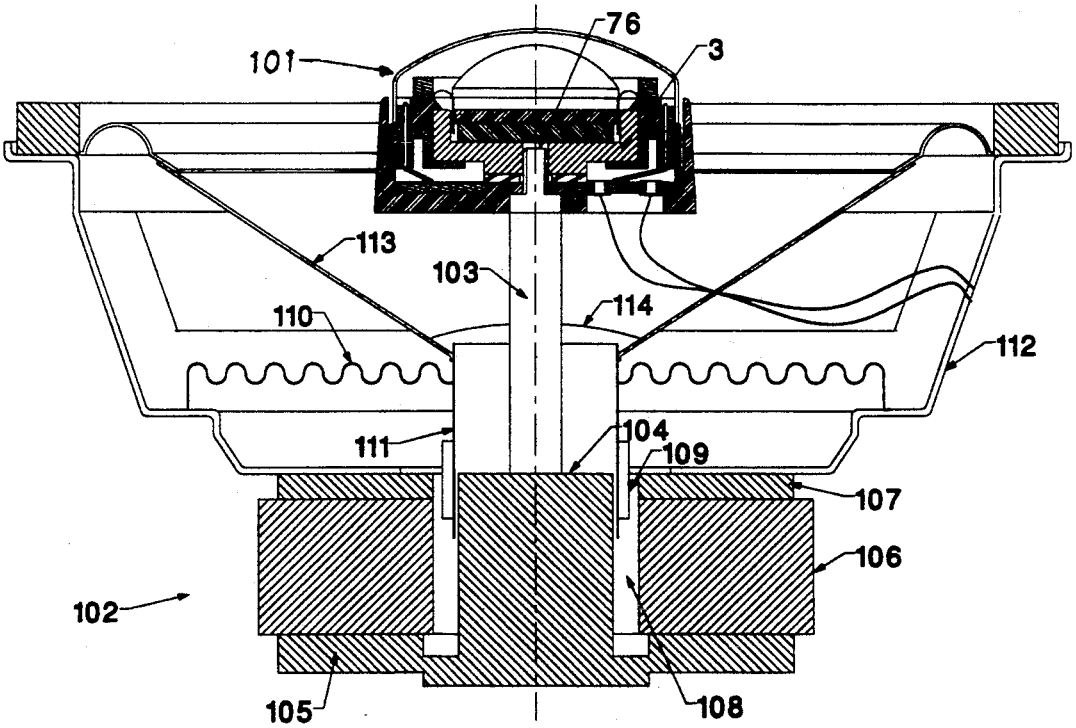
FIG. 7 is a cross-sectional view illustrating the combination of a co-axial arrangement of a tweeter speaker and a woofer wherein the threaded shaft that attaches the two speakers extends from the pole piece of the midrange speaker.
Figure 8:
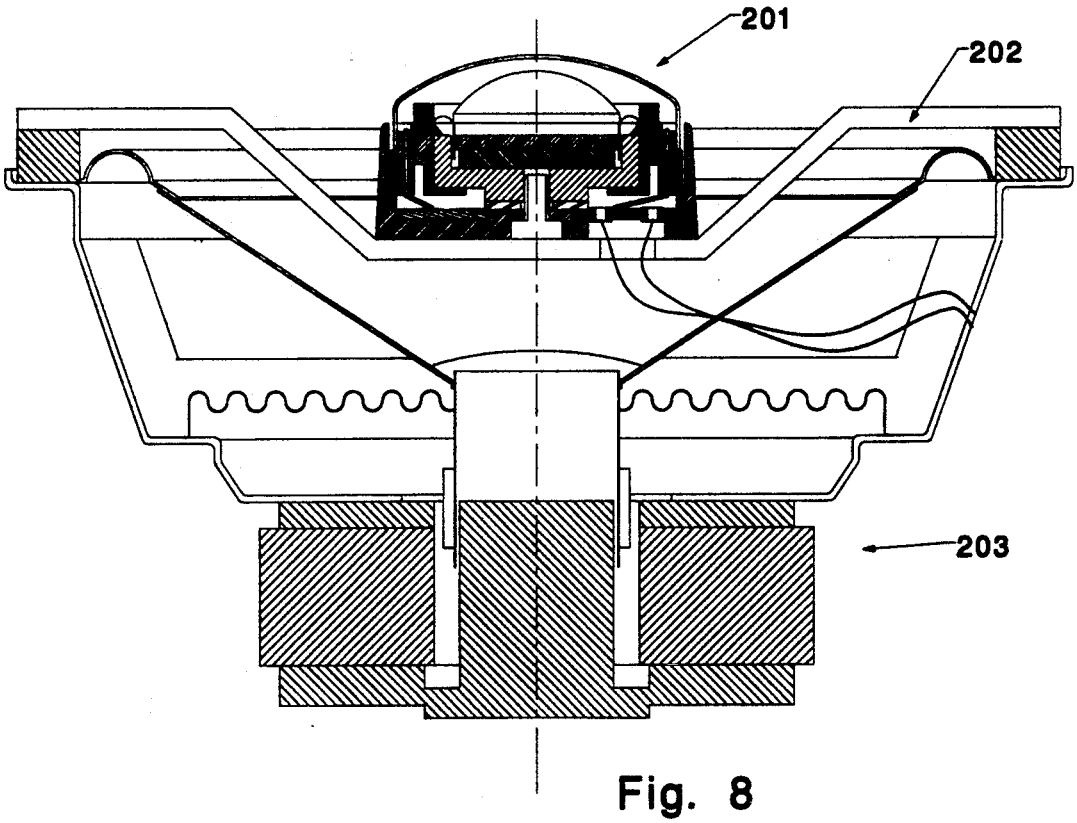
FIG. 8 is a cross-sectional view illustrating an alternate combination of a co-axial arrangement wherein the tweeter speaker is fixed on a conventional manner to a rigid cross support or bridge of the woofer.

Although the preferred embodiments are illustrated utilizing a tweeter assembly, the embodiments of the invention could equally be used with a woofer, as well as a combination of a tweeter and a woofer such as shown in FIGS. 7 and 8.

Figure 1:
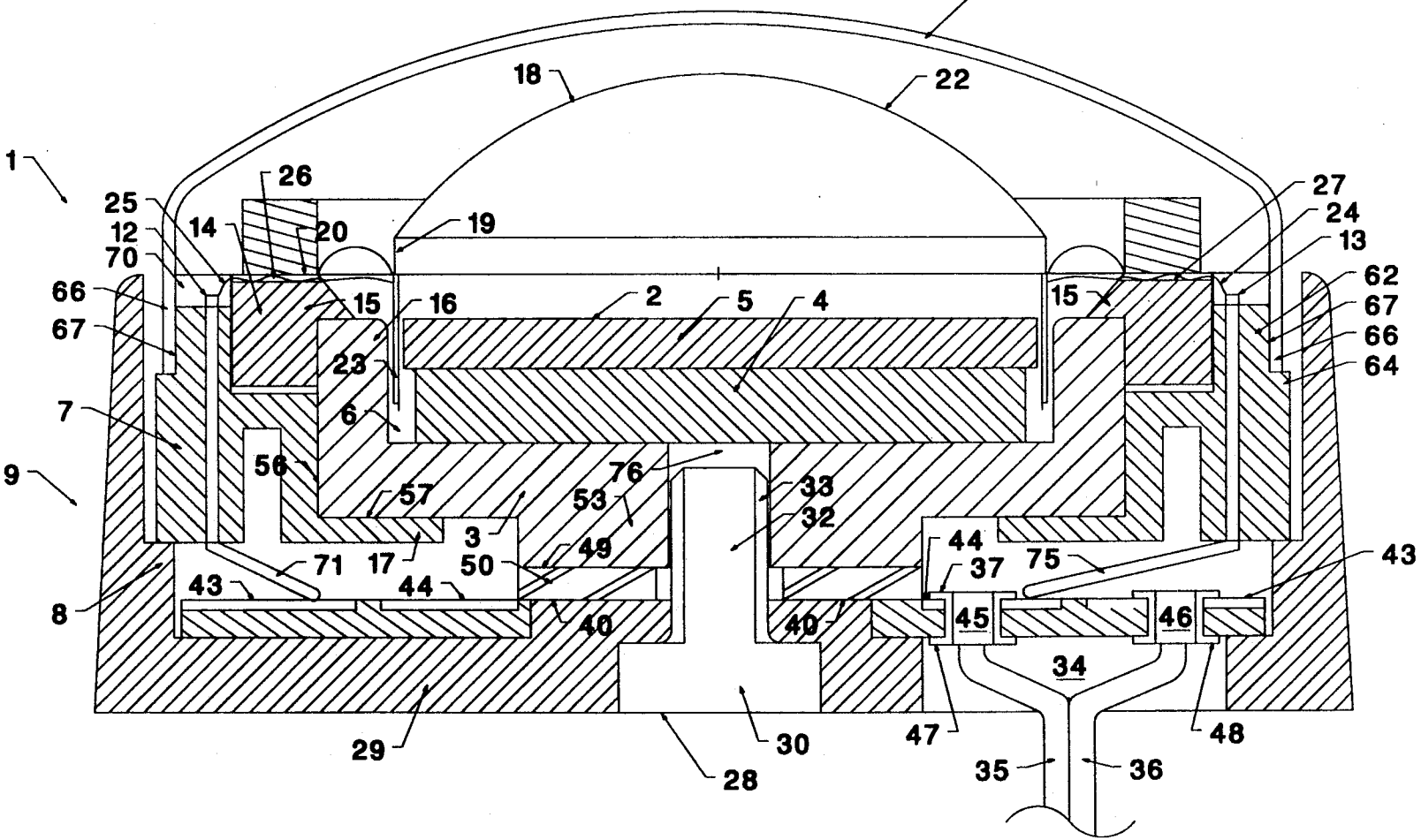
FIG. 1 is a cross-sectional view of a preferred embodiment of a tweeter loudspeaker structured in accordance with this invention. In a preferred embodiment the loudspeaker construction will be provided with a 360° electrical contact surface between the loudspeaker terminals for connection to an external electrical power source.
Figure 2A:
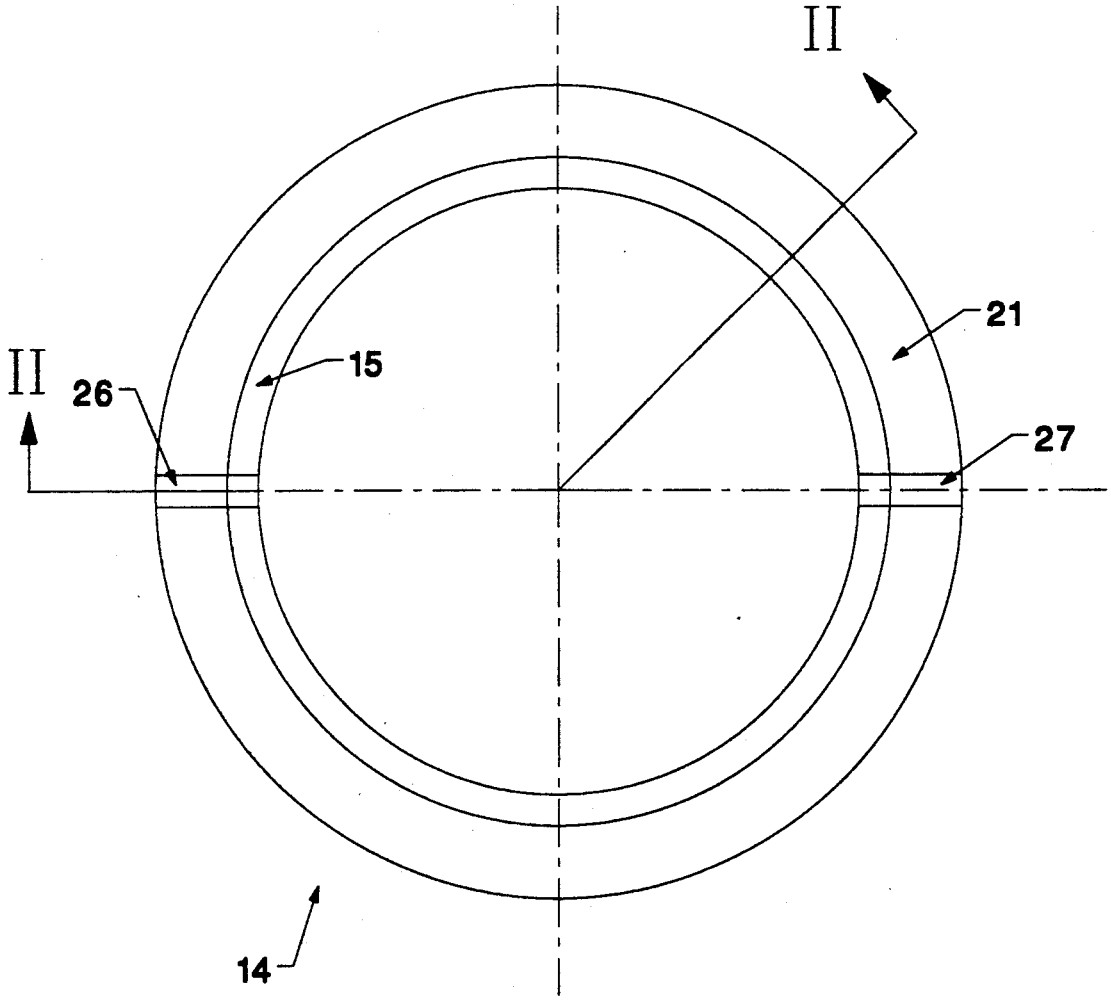
FIG. 2A is a top view of the butterfly ring utilized in the preferred embodiment illustrated in FIG. 1.
Figure 2B:
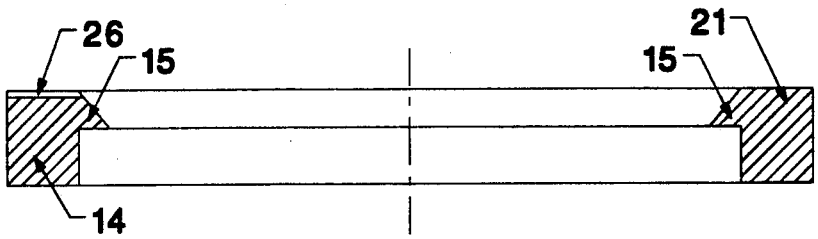
FIG. 2B is a composite cross-sectional view taken along lines II—II of FIG. 2A.
Figure 3A:
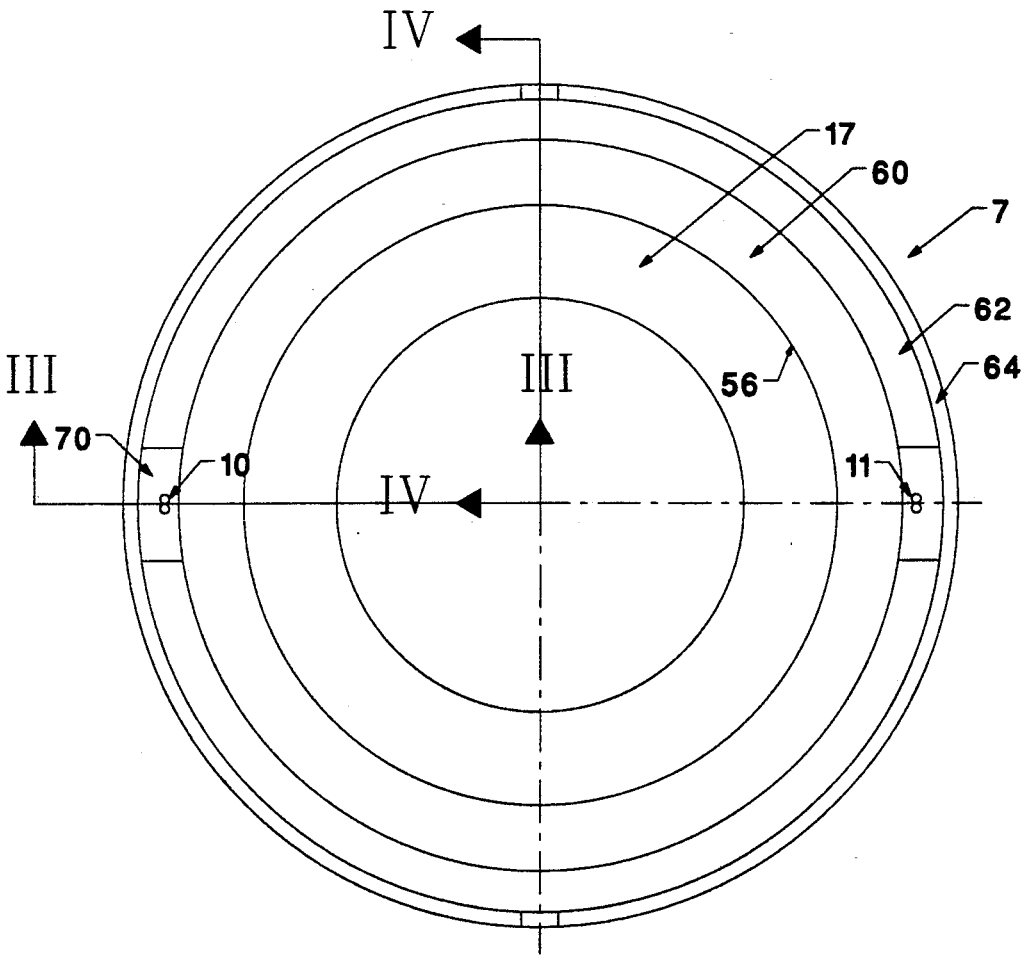
FIG. 3A is a top view of the magnet base utilized in the preferred embodiment illustrated in FIG. 1.
Figure 3B:
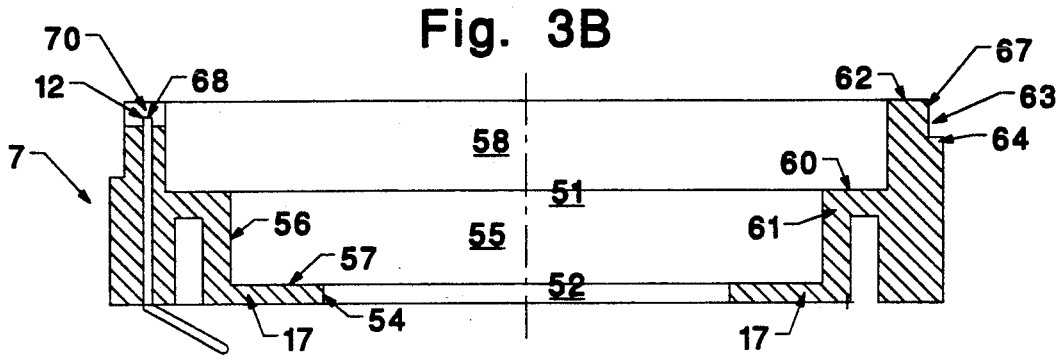
FIG. 3B is a composite cross-sectional view taken along lines III—III and IV—IV of FIG. 3A.

Turning now to FIG. 1, a loudspeaker 1 is illustrated having a yoke assembly 2 comprising yoke 3, magnet 4 and top plate 5 fixedly attached to one another to form air gap 6. Yoke assembly 2 is positioned on magnet base 7 which in turn is positioned on shoulder section 8 of base member 9. Magnet base 7 (See also FIGS. 3A and 3B) is provided with passageways 10 and 11 through which electrical terminals 12 and 13, respectively, extend. A butterfly ring 14 (See also FIGS. 2A and 2B) is positioned between yoke 3 and magnet base 7, and is provided with lip 15 that rests on top surface 16 of yoke 3 positioning yoke assembly 2 on lower ring shoulder 17 of magnet base 7 and aligning diaphragm 18 and voice coil former 19 with gap 6. Diaphragm 18 extends above and about the outer surface of voice coil former 19. Diaphragm 18 is provided with a perimeter lip section 20 that is positioned on the upper surface 21 of butterfly ring 14 and a dome section 22 which extends over yoke assembly 2 as shown. Wrapped about voice coil former 19 and extending into air gap 6 is voice coil 23. Wires 24 and 25 which form part of voice coil 23 extend into and through channels 26 and 27, respectively, cut into surface 21.

Base member 9 is provided with stud 28 which extends from the center section 29 of base member 9. Preferably, stud 28 is provided with a head member 30 that is positioned during the molding process into a cavity 31 formed in center section 29 so that stud 28 is fixed in position so as not to rotate or otherwise move. Stud 28 is also provided with shaft 32 which extends vertically from head member 30 and which has a threaded section 33 at its extending end. Shaft 32 will be of sufficient length so that threaded section 33 can be screwed into yoke 3 as described in more detail below.

In a more preferred embodiment center section 29 is provided with slot 34 through which electrical wires 35 and 36 from a power source (not shown) pass to operatively contact printed circuit (PC) board 37 as described in more detail below. In addition center section 29 is provided with multiple openings 38 (See FIG. 4C) through which screws 39 can pass to attach base member 9 to a permanent mounting plate (not shown) recessed in a wall or car door or any other place where it is desired to mount the loudspeaker.

The interior bottom surface 40 of center section 29 is provided with a recess 41 about shaft 32 shaped to receive the circular PC board 37.

As seen in FIGS. 5A and 5B, PC board 37 is constructed of a circular support plate 42 and two concentric, but non-contacting circular electrical surface plates 43 and 44. Plates 42, 43, and 44 have openings which are aligned to form to openings 45 and 46 wherein solder rivets 47 and 48 are affixed. Openings 45 and 46 are positioned over slot 34 so that wires 35 and 36 can be soldered or otherwise affixed to solder rivets 47 and 48, respectively.

Positioned about threaded stud 28 and between yoke bottom surface 49 and center section surface 40 is gasket 50 which is constructed of non-conductive matter, and is preferably constructed of rubber or similar material which will create a friction lock between yoke bottom surface 49 and center section surface 49 sufficient to prevent any rotation of the yoke assembly 2 when loudspeaker 1 is assembled.

In the alternate embodiment the facing sections of surfaces 40 and 49 could be provided with grooves or rough surfaces so that when they are compressed against one another a friction lock will occur sufficient to prevent any rotation of the yoke assembly 2. Other known means such as keying arrangements could also be used to prevent the rotation of the yoke assembly 2.

Referring to FIGS. 3A, 3B and 6A, 6B, 6C, and 6D, magnet base 7 is constructed from a single block having a center circular cavity 51 extending through the vertical axis of the block and shaped to receive yoke 3. Cavity 51 is composed of three connecting cavities: bottom cavity 52 through which stud receiver section 53 of yoke 3 extends and which is formed by the side wall 54 of lower shoulder section 17; middle cavity 55 formed by side wall 56 and top surface 57 of lower shoulder section 17 on which yoke 3 rests; and top cavity 58 formed by side wall 59 and top surface 60 of middle section 61. The top section 62 of magnet base 7 is provided with a circular peripheral notch 63 forming shoulder section 64 on which perforated grill 65 rests. The peripheral edge 66 of grill 65 fits snugly about side wall 67 of top section 62.

In a preferred embodiment terminal 12 will be constructed by folding a wire in half so that the top end pieces 68, 69 will extend through passageway 10 and into notch 70. The bottom section 71 of terminal 12 will be bent after it extends from the other end of passageway 10, and the double strand of the wire spread apart as illustrated in FIGS. 6A and 6C so as to contact surface plate 43 of PC board 37. Terminal 13 will be constructed in similar fashion so that its top end pieces 72, 73 will extend through passageway 11 and into notch 74. The bottom section 75 of terminal 13 is bent after it extends from the other end of passageway 11, and the double strand of the wire spread apart as illustrated in FIGS. 6B and 6D so as to contact surface plate 44 of the PC board. This configuration allows PC board 37 to act as a 360° surface contact between terminals 12 and 13 and the external electrical power source.

To mount loudspeaker 1, one affixes base member 9 to the desired mounting surface by using screws 39. If not already in place gasket 50 is then slipped over shaft 32, and the threaded opening 76 of yoke 3 is screwed onto shaft 32 until terminal bottom sections 71, 75 have contacted PC board plates 43, 44, respectively, and gasket 50 has been compressed sufficiently to form a friction lock to prevent yoke 3 from rotating during normal play of the loudspeaker.

To remove loudspeaker 1 to a different base member or simply store it in a safe place when it is not being used, one merely unscrews yoke 3 from shaft 32.

In an alternate embodiment as shown in FIG. 7 the tweeter loudspeaker 101 can be mounted to a conventional loudspeaker 102 that has been modified so that a stud extension 103 extends upward from the woofer pole piece 104 a sufficient distance to screw into threaded opening 76 of yoke 3. Loudspeaker 102 is constructed having a backplate 105 from which Woofer pole piece 104 extends. A ceramic magnet 106 is affixed between backplate 105 and field plate 107 in position to form gap 108 into which voice coil 109 is positioned. One perimeter edge of flexible "spider" 110 is affixed in a conventional manner to voice coil former 111. The other perimeter edge of flexible "spider" 110 is affixed to a rigid frame 112 that houses in a conventional fashion cone 113.

In this embodiment stud extension 103 which extends through dust cap 114 covering voice coil former 111 takes the place of stud 28 discribed above. All other aspects of the tweeter loudspeaker would remain as shown in FIG. 1.

In another alternate embodiment as shown in FIG. 8 the tweeter loudspeaker 201 is affixed in a conventional manner to a rigid cross-support or bridge 202 extending over loudspeaker 203. In this embodiment tweeter loudspeaker 201 is identical to the loudspeaker shown in FIG. 1 and the other features of the midrange loudspeaker 203 are identical to the midrange loudspeaker 102 shown in FIG. 7.

There are of course other alternate embodiments which are obvious from the foregoing descriptions of the invention which are intended to be included within the scope of the invention as defined by the following claims.

What I claim is:

1. In a loudspeaker having a yoke assembly including a top plate and a yoke fixedly attached to opposite sides of a magnet to form an air gap between said plate and said yoke into which a voice coil operatively extending from a diaphragm is positioned, said yoke affixed to a magnet base through which electrical terminals extend, one end of said terminals being operatively attached to said voice coil, said magnet base having an open end near said diaphragm and being positioned in a housing and said magnet base having a grille covering its open end, and its end opposite the open end being enclosed by a base member of said housing, the improvement to which comprises: a stud having a head member fixed to said base member and having a shaft extending upward from said base member and toward said yoke, said shaft having a threaded section and being of sufficient length to be screwed into a mating threaded opening in the center section of said yoke, and at least one passageway extending through said base member to allow electrical wire to pass for operative attachment to said electrical terminals; and wherein said base member is frictionally lockable to said yoke assembly when said threaded section is screwed into said threaded opening.

2. A loudspeaker according to claim 1 further comprising means attached to said base member and having a 360° electrical conducting surface to which said terminals operatively contact for any rotational orientation of said base member, said conducting surface being connectable to an external electrical power source.

3. A loudspeaker according to claim 1 further comprising a gasket positioned about said shaft and between said yoke assembly and said base member to frictionally lock said yoke assembly to said base member when said threaded section is screwed into said threaded opening.

4. A loudspeaker according to claim 1 wherein said base member is affixed to a rigid cover of a second loudspeaker.

5. A loudspeaker system comprising a tweeter loudspeaker affixed to a midrange loudspeaker wherein said tweeter loudspeaker comprises: a yoke assembly including a top plate and a yoke fixedly attached to opposite sides of a magnet to form an air gap between said plate and said yoke into which a voice coil operatively extending from a diaphragm is positioned, said yoke affixed to a magnet base through which electrical terminals extend, one end of said terminals being operatively attached to said voice coil, said magnet base having an open end near said diaphragm and being positioned in a housing and said magnet base having a grille covering its open end, and its end opposite the open end being enclosed by a base member of said housing, and said midrange loudspeaker comprises: a stud member having a threaded end extending vertically from a pole piece and through a dust cap covering a voice coil former and operatively into a mating threaded opening in said yoke to affix said tweeter loudspeaker to said midrange loudspeaker.

6. A loudspeaker according to claim 1 further comprising means attached to said base member and having a 360° electrical conducting surface to which said terminals operatively contact for any rotational orientation of said base member, said conducting surface being connectable to an external electrical power source.

* * * * *